US010066279B2

(12) United States Patent
Kellezi et al.

(10) Patent No.: US 10,066,279 B2
(45) Date of Patent: Sep. 4, 2018

(54) METHOD FOR PRODUCING OBJECTS FROM IRON—COBALT—MOLYBDENUM/TUNGSTEN—NITROGEN ALLOYS

(71) Applicant: BOEHLER EDELSTAHL GMBH & CO. KG, Kapfenberg (AT)

(72) Inventors: Gert Kellezi, Leoben (AT); Robert Tanzer, Leoben (AT); Christoph Turk, Leoben (AT)

(73) Assignee: Boehler Edelstahl GmbH & Co. KG, Kapfenberg (AU)

( * ) Notice: Subject to any disclaimer, the term of this patent is extended or adjusted under 35 U.S.C. 154(b) by 714 days.

(21) Appl. No.: 14/557,903

(22) Filed: Dec. 2, 2014

(65) Prior Publication Data

US 2015/0167132 A1 Jun. 18, 2015

(30) Foreign Application Priority Data

Dec. 12, 2013 (AT) ..... A 50820/2013

(51) Int. Cl.
*C22C 38/22* (2006.01)
*B22F 3/24* (2006.01)
(Continued)

(52) U.S. Cl.
CPC ..... *C22C 38/22* (2013.01); *B22F 3/24* (2013.01); *C21D 1/26* (2013.01); *C21D 6/007* (2013.01);
(Continued)

(58) Field of Classification Search
CPC ..... B22F 3/24; B22F 2005/001; C22C 38/22
See application file for complete search history.

(56) References Cited

U.S. PATENT DOCUMENTS 4,011,108 A * 3/1977 Hellman ..... B22F 3/16 148/905
6,057,045 A 5/2000 Wojcieszynski et al.
(Continued)

FOREIGN PATENT DOCUMENTS

CN 101258258 A 9/2008
DE 2122439 11/1972
(Continued)

OTHER PUBLICATIONS

Danniger et al., "Powder Metallurgy Carbon Free Tool Steels Fe—Co—Mo With Varying Co and Mo Contents," Powder Metallurgy Progress, Jul. 2013, pp. 47-56.
(Continued)

*Primary Examiner* — Weiping Zhu
(74) *Attorney, Agent, or Firm* — Rankin, Hill & Clark LLP

(57) ABSTRACT

The disclosure relates to a production of a semi-finished product for a manufacturing of objects, particularly tools, from a precipitation-hardenable alloy having a composition in wt. % of Co=15.0 to 30.0, Mo up to 20.0, W up to 25.0, Fe and manufacturing-specific impurities as a remainder. To achieve an economical, highly precise production of objects or tools of the above alloy with reduced effort, it is provided to prevent a formation of ordered structures of the Fe atoms and Co atoms in the matrix of the type (Fe+(29×Co))+ approximately 1 wt. % Mo of the semi-finished product by a thermal special treatment, to thus improve a workability of the material.

5 Claims, 2 Drawing Sheets

(51) Int. Cl.

| | |
|---|---|
| ***C21D 6/00*** | (2006.01) |
| ***C22C 38/00*** | (2006.01) |
| ***C22C 38/10*** | (2006.01) |
| ***C22C 33/02*** | (2006.01) |
| ***C21D 1/26*** | (2006.01) |
| *C21D 6/02* | (2006.01) |

(52) U.S. Cl.
CPC ..... *C22C 33/0285* (2013.01); *C22C 38/001* (2013.01); *C22C 38/10* (2013.01); *B22F 2003/248* (2013.01); *B22F 2998/10* (2013.01); *C21D 6/02* (2013.01)

(56) References Cited

U.S. PATENT DOCUMENTS

| | | | |
|---|---|---|---|
| 6,783,568 | B1 | 8/2004 | Bowskill et al. |
| 6,861,161 | B2 | 3/2005 | Ponemayr et al. |
| 2006/0280639 | A1 | 12/2006 | Lengauer et al. |
| 2009/0007992 | A1* | 1/2009 | Caliskanoglu ..... C22C 33/0285 148/328 |
| 2009/0199930 | A1 | 8/2009 | Wright et al. |
| 2015/0167132 | A1 | 6/2015 | Kellezi et al. |

FOREIGN PATENT DOCUMENTS

| | | |
|---|---|---|
| DE | 10322871 | 12/2004 |
| EP | 1990438 | 11/2008 |
| JP | 59-150064 | 8/1984 |
| RU | 2137860 C1 | 9/1999 |
| SU | 829714 | 5/1981 |

OTHER PUBLICATIONS

Danniger et al., "Heat Treatment and Properties of Precipitation Hardended Carbon-Free PM Tool Steels," Powder Metallurgy Progress, Metal Power Industries Federation, Jan. 2005, pp. 92-103.

Danniger et al., "Powder Metallurgy Manufacturing of Carbon-Free Precipitation Hardened High Speed Steels," Acta Physica Polonica A, 2010, pp. 825-830.

Austrian Search Report in related Application No. A50820/2013, dated Jun. 25, 2014.

European Search Report in related European Application No. EP14192704, dated Jul. 3, 2015.

Espacenet bibliographic data for CN101258258 published Sep. 3, 2008, one page.

Espacenet bibliographic data for E2122439 published Nov. 30, 1972, one page.

Espacenet bibliographic data for JPS59150064 published Aug. 28, 1984, one page.

Espacenet bibliographic data for RU2137860 published Sep. 20, 1999, one page.

Machine translation for SU829714 published May 15, 1971, two pages.

* cited by examiner

METHOD FOR PRODUCING OBJECTS FROM IRON—COBALT—MOLYBDENUM/TUNGSTEN—NITROGEN ALLOYS

CROSS-REFERENCE TO RELATED APPLICATIONS

The present application claims priority under 35 U.S.C. § 119 of Austrian Patent Application No. A50820/2013, filed Dec. 12, 2013, the disclosure of which is expressly incorporated by reference herein in its entirety.

BACKGROUND OF THE DISCLOSURE

1. Field of the Disclosure

Embodiments generally relate to objects of iron-cobalt-molybdenum/tungsten-nitrogen alloys and to a production of the same.

Described more precisely, embodiments relate to a semi-finished product for producing objects and a method for improving the workability of precipitation-hardenable iron-cobalt-molybdenum/tungsten-nitrogen alloys.

2. Discussion of Background Information

Tools or objects of precipitation-hardenable iron-cobalt-molybdenum and/or tungsten-nitrogen alloys having a chemical composition in wt. % of:

| | |
|---|---|
| Cobalt (Co) | 15.0 to 30.0 |
| Molybdenum (Mo) | up to 20.0 |
| Tungsten (W) | up to 25.0 |
| Molybdenum + 0.5 tungsten (Mo + W/2) | 10.0 to 22.0 |
| Nitrogen (N) | 0.005 to 0.12 |

Iron (Fe) and manufacturing-specific impurities as a remainder, are known and are disclosed, for example, in AT 505 221 B1.

A production of the semi-finished product advantageously takes place by a powder-metallurgical (PM) process, whereby a homogeneous material structure can be achieved.

A PM production, particularly a manufacturing of a hot-isostatically pressed (HIP) ingot from alloyed powder atomized from a molten mass, is known to the ordinarily skilled artisan and therefore does not require a detailed description.

The method for a production of objects essentially comprises a hot forming of the HIP ingot with subsequent cooling, after which the Fe—Co—Mo/W—N material exhibits a hardness of mostly 48 to 53 HRC, is extremely brittle and does not permit any significant working.

In preparation for a manufacturing of an object, particularly of a tool, there thus occurs a soft-annealing of the formed ingot or of the semi-finished product in the austenite region, that is, above the $A_{C3}$ temperature of the alloy, followed by a slow cooling.

A heat treatment of this type leads to a reduced hardness of the material of approximately 41 HRC and higher, a toughness or notched bar impact work K of approx. 14 J and an elongation at fracture in the area of $A_C$=4% in the tensile test.

In any case, a dimensionally accurate production of an object, possibly of a tool, from the soft-annealed semi-finished product or a soft-annealed primary material must be carried out in a complex manner by a metal-removing processing, wherein a straightening or alignment of the formed pieces often leads to breakage of the blank.

A thermal finishing of the part made from the semi-finished product normally takes place by a heat treatment with a solution annealing, followed by a quenching and a tempering, wherein a hardness of the material of possibly 68 HRC can be achieved.

An object, part or tool made of an Fe—Co—Mo/W—N alloy has optimal use characteristics for a plurality of specific requirements, but requires complex production due to the material.

SUMMARY OF EMBODIMENTS OF THE DISCLOSURE

An aim of embodiments is to now disclose a semi-finished product of an alloy with a composition named at the outset, from which semi-finished product highly precise objects or tools can be manufactured with reduced effort.

An aim of the embodiments is furthermore to reduce the hardness of the semi-finished product as well as to increase the toughness and elongation at fracture of the material, and to thus improve a workability of the alloy and the efficiency of the working of the same.

The aim is attained for a generic semi-finished product if this product is essentially formed from intermetallic phases of the type $(FeCo)_6(Mo+W/2)_7$ in a matrix of the type (Fe+(29×Co))+approximately 1 wt. % Mo, wherein, in the matrix, essentially no ordered structures of the Fe atoms and Co atoms are present or a formation of an Fe—Co ordered structure is prevented to a large extent, and the material thus has a hardness of under 40 HRC, an impact bending work K of unnotched samples of greater than 16.0 J, and an elongation at fracture $A_C$ of greater than 6.5% in the tensile test.

According to a preferred form of the invention, the material has a tensile strength Rm of less than 1220 MPa and an elongation limit $R_{P0.2}$ of less than 825 MPa.

A semi-finished product according to the invention has the advantage of a significantly improved workability. On the one hand, the material hardness, which typically lies in the range above 41 HRC, is essentially lowered below 40 HRC in the material according to the invention, which facilitates a metal-removing processing; on the other hand, the material brittleness is reduced and the strength and formability are improved in the cold state, which permits a straightening of the semi-finished product within limits.

These advantages are attained in that, as was found, a material according to the invention has a significantly reduced ordered structure of the Fe atoms and Co atoms in the matrix, and thus, renders possible a low plasticity of the same, despite a high phase content, which is revealed by the mechanical material values achieved.

The other aim of the invention is attained for a method for producing a semi-finished product named at the outset by a thermal special treatment for breaking up an ordered structure of Fe—Co atoms in the matrix, wherein a heating and an annealing of the part or material occur at a temperature between 600° C. and 840° C. for a period of more than 20 min, after which the semi-finished product is subjected to a cooling with a cooling rate λ of less than 3, and a reduction or adjustment of a hardness to under 40 HRC thus occurs with an improved material toughness of greater than 16.0 J of the material (measured using the impact bending work of unnotched samples K).

It was completely surprising for the ordinarily skilled artisan that a breaking-up of the atomic ordered structure in the matrix is achievable within the temperature range of the upper ferrite region of the alloy between 600° C. and 840° C. after a corresponding length of time without obtaining a disorder and that a mostly disordered distribution of the Fe atoms and Co atoms in the matrix is subsequently maintained, or can be frozen, at a high cooling rate and an improvement of the workability of the semi-finished product is thus created.

After an economical finishing, for example, of a tool from a semi-finished product according to the invention, a thermal hardening can be performed mostly without warping by solution annealing, followed by a quenching and a tempering of the object, wherein a desired hardness of the material of possibly 68 HRC can be achieved.

The invention is to be illustrated in greater detail on the basis of the development work.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The tests took place using samples made of an alloy having a composition in wt. % of:

Co=25.2
Mo=14.9
W=0.1
Mo+W/2=15.0
N=0.02
Fe remainder and manufacturing-specific impurities, and a hardness of 48 to 53 HRC, which were produced from a material manufactured according to the PM methods and hot-isostatically pressed and formed.

A series of samples was soft-annealed at a temperature of 1185° C. and subsequently cooled at 24° C./h. After this soft-annealing treatment, the samples had on average the following measured values:

Hardness of 41.2 HRC±0.5 HRC,
Impact bending work 14.5 J±0.6 J,
Elongation at fracture 4.8 $A_C$±0.2%=$A_C$,
Tensile strength Rm 1290 MPa±20 MPa, and
Elongation limit $R_{P0.2}$ 855 MPA±10 MPa.

Figure 1:
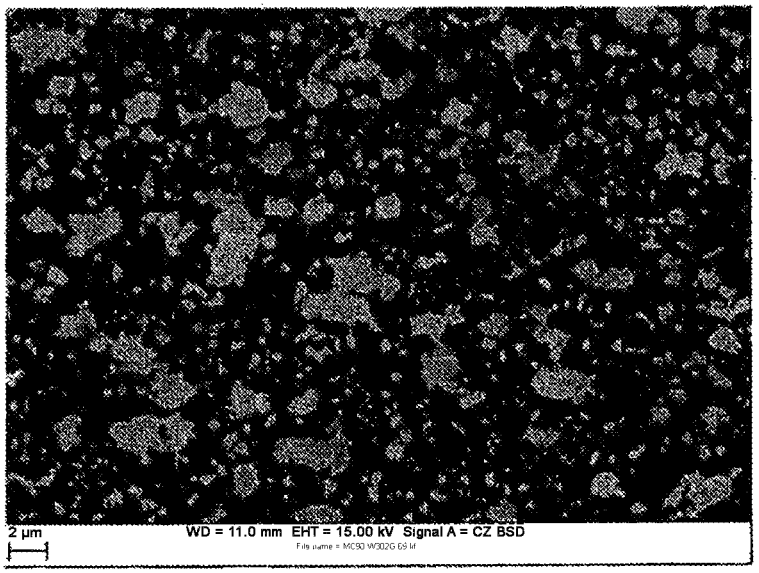
FIG. 1 shows the microstructure of an Fe—Co—(Mo+W/2) N alloy.

FIG. 1 shows a structural image of the sample, wherein the matrix can be recognized as a dark region in which intermetallic phases (light) are intercalated.

On other similarly treated samples, a thermal special treatment occurred at temperatures of 500° C. to 950° C. with an annealing time or at-temperature holding time of 40 min and a cooling rate λ of less than 0.4. The cooling rate λ results from the cooling time from 800° C. to 500° C. divided by 100.

$$\lambda = \frac{\text{sec}}{100}$$

Figure 2:
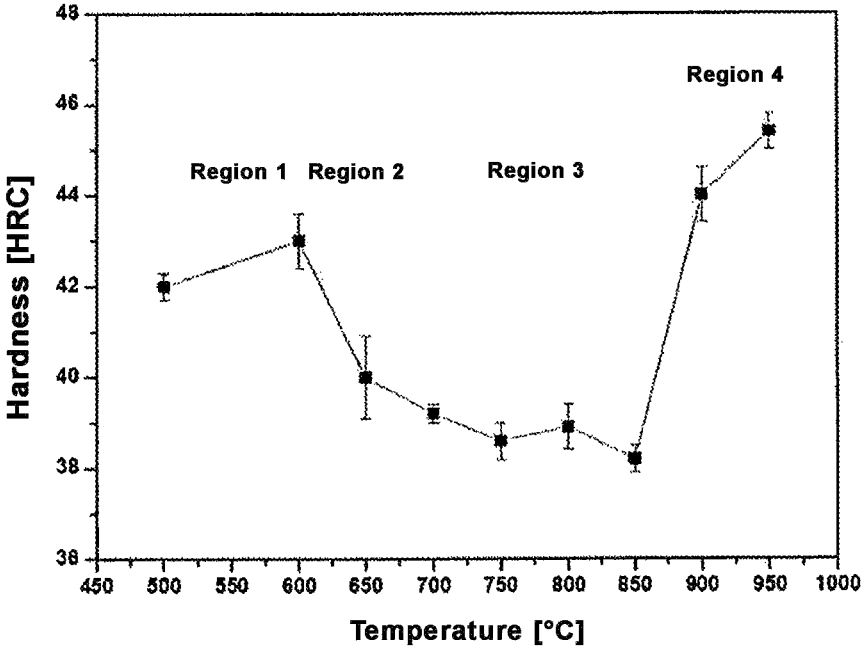
FIG. 2 shows the hardness as a function of the annealing temperature for the thermal special treatment of the semi-finished product.

A special annealing with a temperature of 500° C. to 600° C. results in, as FIG. 2, Region 1 shows, hardness values of the material of 42 HRC. Higher annealing temperatures up to 850° C., as can be seen from Region 2 and Region 3 of FIG. 2, lower the material hardness to values up to 38 HRC, wherein an additional increase in the annealing temperature (Region 4) produces a significant hardness increase to over 44 HRC.

Figure 3:
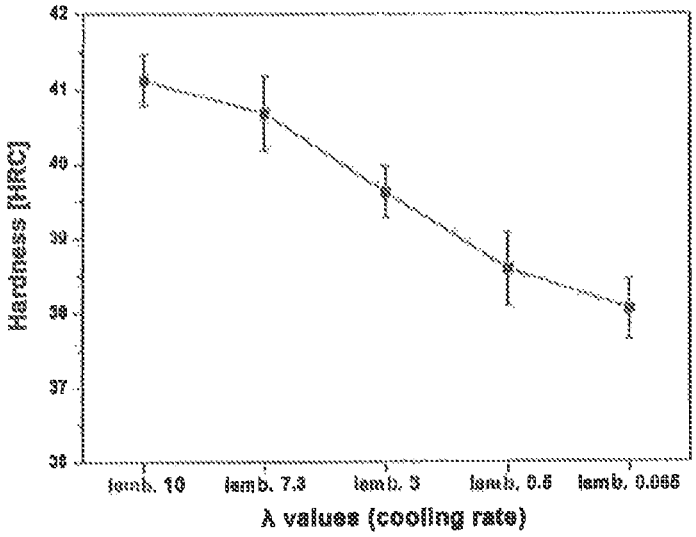
FIG. 3 shows the hardness as a function of the cooling rate.

If the samples are kept at 800° C. for 30 minutes after a special annealing and subsequently cooled with different λ values, average hardness values of 41.18 HRC at λ 10 decreasing to 38 HRC at λ 0.4 and lower are achieved, as is illustrated in FIG. 3.

To determine the ordered structure of atoms in crystalline solids, the diffraction of neutron beams at the periodic lattice can be used. By a periodical arrangement of atoms in the Fe—Co lattice, what are known as superstructure reflections occur. The superstructure is the (100) reflection in the ordered B2 lattice.

Figure 4:
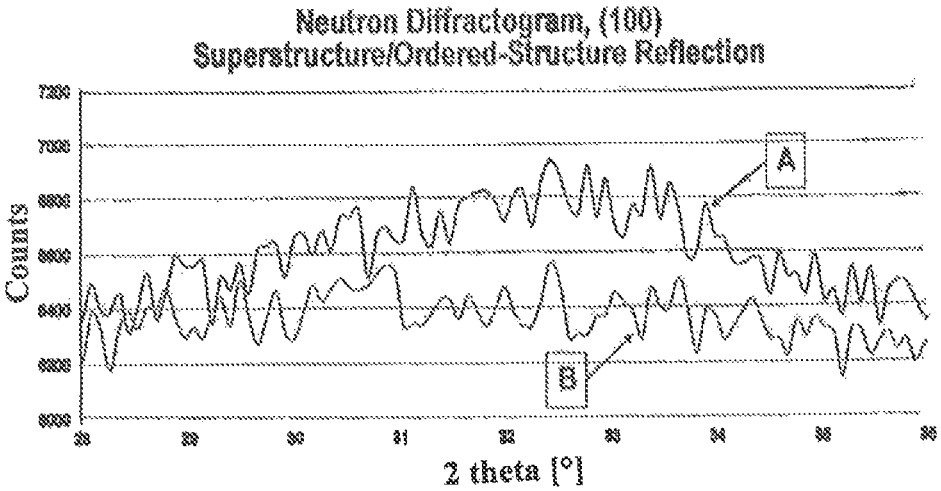
FIG. 4 shows the Fe—Co ordered structures from neutron diffractometry.

On soft-annealed samples A and on such samples with an additional thermal special treatment B, an ordered phase of the Fe atoms and Co atoms in the matrix was determined by neutron diffractometry using a STRESS-SPEC diffractometer with a Ge 311 monochromator, wavelength of 16 nm. FIG. 4 shows contrastingly a neutron diffractogram (100) of the superstructure/ordered-structure reflections of the samples A and B in comparison.

A largely disordered Fe—Co structure is clearly present in a matrix B specially treated according to the invention.

It is noted that the foregoing examples have been provided merely for the purpose of explanation and are in no way to be construed as limiting of the present disclosure. While the present disclosure has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present disclosure in its aspects. Although the present disclosure has been described herein with reference to particular means, materials and embodiments, the present disclosure is not intended to be limited to the particulars disclosed herein; rather, the present disclosure extends to all functionally equivalent structures, methods and uses, such as are within the scope of the appended claims.

What is claimed is:

1. A method for producing a semi-finished product for objects or tools from a precipitation-hardenable alloy material having a chemical composition in wt. % including:

| | |
|---|---|
| Cobalt (Co) = | 15.0 to 30.0, |
| Molybdenum (Mo) = | up to 20.0, |
| Tungsten (W) = | up to 25.0, |
| (Mo + W/2) = | 10.0 to 22.0, |
| Nitrogen (N) = | 0.005 to 0.12, |

Iron (Fe) and manufacturing-specific impurities=remainder, the semi-finished product having a hardness of under 40 HRC, a toughness of greater than 16.0 J, the method comprising:

subjecting the alloy material to a thermal special treatment to break up an ordered structure of (Fe—Co) atoms in a matrix of a type (Fe+(29×Co))+approximately 1 wt. % Mo, the thermal special treatment comprising heating and annealing the material at a temperature between 600° C. and 840° C. for a period of more than 20 minutes and subsequent cooling at a cooling rate λ of less than 3.0, to alter the hardness of the material to under 40 HRC and to alter the toughness of the material to greater than 16.0 J, measured using impact work of unnotched samples K.

2. The method according to claim 1, wherein the semi-finished product is a powder-metallurgically produced material (PM material).

3. The method according to claim 1, further comprising a forming of the semi-finished product and a soft-annealing of the semi-finished product prior to the subjecting the alloy material to the thermal special treatment to break up the ordered structure of (Fe—Co) atoms in the matrix.

4. The method according to claim 1, wherein the semi-finished product has an elongation limit $R_{P0.2}$ of less than 825 MPa, a tensile strength Rm of less than 1220 MPa, and an elongation at fracture Ac of greater than 6.5% in a tensile test.

5. A method for producing a semi-finished product for producing objects or tools from a precipitation-hardenable alloy having a chemical composition in wt. % comprising:

| | |
|---|---|
| Cobalt (Co) = | 15.0 to 30.0, |
| Molybdenum (Mo) = | up to 20.0, |
| Tungsten (W) = | up to 25.0, |
| (Mo + W/2) = | 10.0 to 22.0, |
| Nitrogen (N) = | 0.005 to 0.12, and |

Iron (Fe) and manufacturing-specific impurities=remainder, the method comprising:

breaking up an ordered structure of (Fe—Co) atoms in a matrix of a type (Fe+(29×Co))+approximately 1 wt. % Mo using a thermal special treatment comprising:

heating and annealing the material at a temperature between 600° C. and 840° C. for more than 20 minutes, and subsequently cooling the material at a cooling rate λ of less than 3.0, to alter the hardness of the material to under 40 HRC and to alter the toughness of the material to greater than 16.0 J, measured using impact work of unnotched samples K.

* * * * *